US005487701A

United States Patent [19]

Schedegger et al.

[11] Patent Number: 5,487,701

[45] Date of Patent: Jan. 30, 1996

[54] PLASTIC FOUNDATION VENT

[75] Inventors: Charles E. Schedegger, Metamora; Clyde G. Allen, North Branch; Michael C. Clark, Columbiavilla; Aundrea Nurenberg; Jack Wnuk, both of Lapeer, all of Mich.

[73] Assignee: Mid-America Building Products Corporation, Plymouth, Mich.

[21] Appl. No.: 262,237

[22] Filed: Jun. 20, 1994

[51] Int. Cl.[6] ..... F24F 13/08

[52] U.S. Cl. ..... 454/271; 52/302.1; 454/273

[58] Field of Search ..... 52/302.1, 302.3; 454/271, 273, 278

[56] References Cited

U.S. PATENT DOCUMENTS

| | | | |
|---|---|---|---|
| D. 321,557 | 11/1991 | Bezick et al. . | |
| 1,673,379 | 6/1928 | Swift . | |
| 2,116,457 | 5/1938 | Whitmarsh . | |
| 2,505,147 | 4/1950 | Scallon . | |
| 2,611,310 | 9/1952 | Cowan . | |
| 3,192,849 | 7/1965 | Massengale . | |
| 3,220,079 | 11/1965 | Aggson | 454/271 |
| 4,175,480 | 11/1979 | Beam, Jr. et al. | 454/278 |
| 4,249,460 | 2/1981 | McSwaih | 454/273 |
| 4,274,330 | 6/1981 | Witten et al. . | |
| 4,592,271 | 6/1986 | Young . | |
| 4,669,371 | 6/1987 | Sarazen, Jr. et al. . | |
| 4,875,318 | 10/1989 | MacLeod et al. | 52/211 |
| 5,293,920 | 3/1994 | Vagedes | 52/302.1 X |
| 5,349,799 | 9/1994 | Schidegger et al. | 52/302.1 X |

*Primary Examiner*—Harold Joyce

*Attorney, Agent, or Firm*—Barnes, Kisselle, Raisch, Choate, Whittemore & Hulbert

[57] ABSTRACT

The plastic foundation vent embodying the invention comprises a plastic body with an integral peripheral rectangular wall surrounding the plastic body and defining opposed long sides and opposed short sides, an integral peripheral flange extends outwardly from the peripheral wall. A central integral screen portion having openings for bending and prevention of entry of animals and the like is provided within the peripheral wall. The peripheral flange has a front surface and a rear surface. A first groove is provided on the rear surface of one of the flanges alongside to define a live hinge line permitting the flange to be bent backwardly and forwardly. A second groove on the front surface of the flange on each of the short sides permits bending of the flange along the short sides, A third groove on the front surface of the flange along the short sides permits bending of the short sides about a second live hinge, cutting lines ace provided at right angles on the flange having live hinge to permit corners of the flange to be cut for use in replacement of a foundation vent.

10 Claims, 5 Drawing Sheets

FIG.13
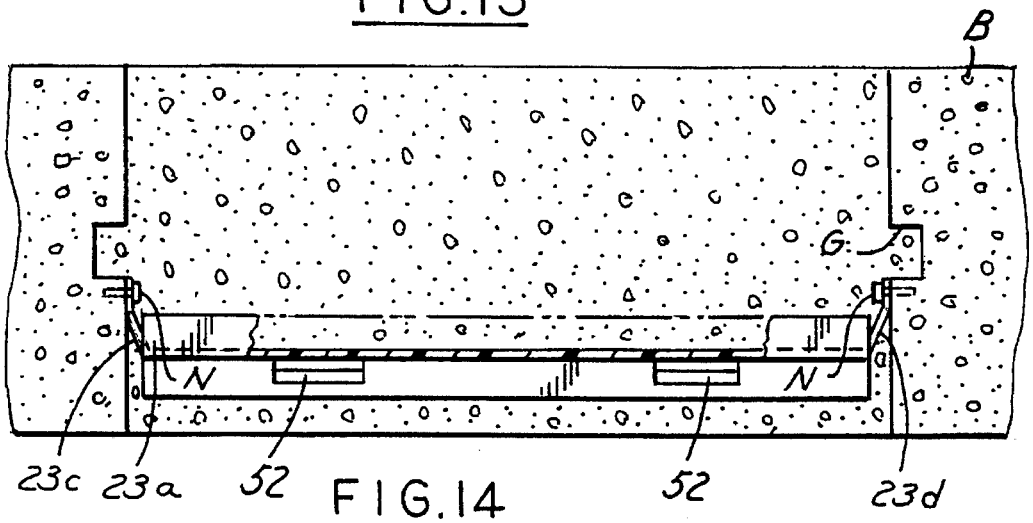
FIG.14
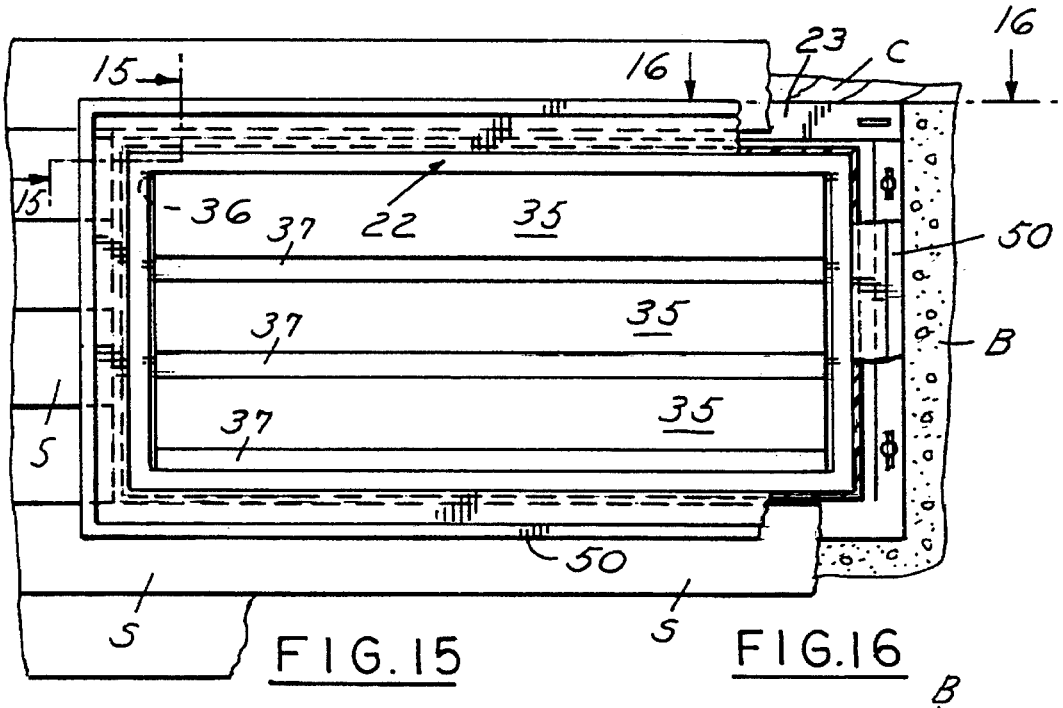
FIG.15
FIG.16
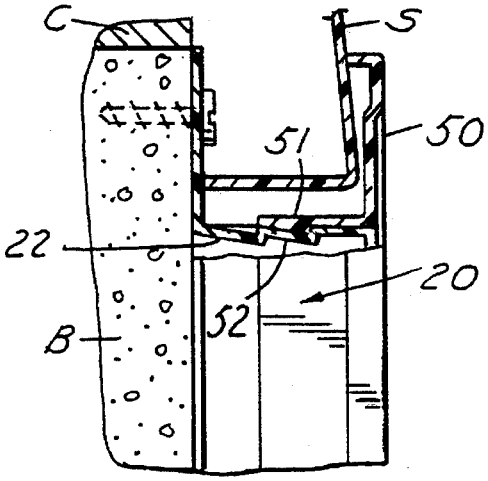
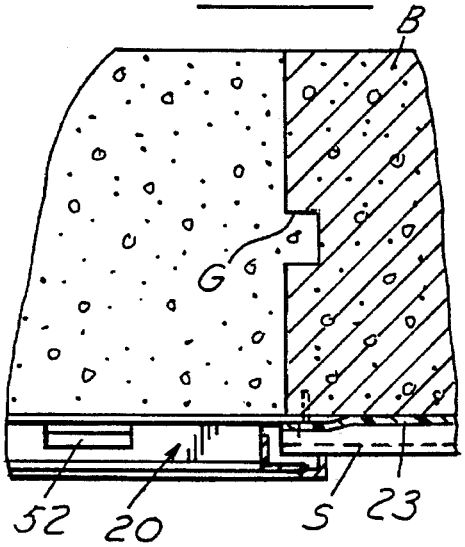

PLASTIC FOUNDATION VENT

This invention relates to foundation vents and particularly to a plastic foundation vent.

BACKGROUND AND SUMMARY OF THE INVENTION

In certain types of buildings and homes, it is common to provide a foundation vent which is usually placed in an opening in the wall or foundation. The foundation may consist of a cement block wall or a poured concrete wall. Such foundation vents become damaged and require replacement which is difficult and not readily done.

Among the objects of the present invention are to provide a plastic foundation vent which can be used in new construction; which can be readily applied as a replacement vent; and which can be adapted for use in an opening that has siding and the like associated therewith.

In accordance with the invention, the plastic foundation vent embodying the invention comprises a plastic body with an integral peripheral rectangular wall surrounding the plastic body and defining opposed long sides and opposed short sides. An integral peripheral flange extends outwardly from the peripheral wall. A central integral screen portion having openings for bending and prevention of entry of animals and the like is provided within the peripheral wall. The peripheral flange has a front surface and a rear surface. A first groove is provided on the rear surface of one of the flanges alongside to define a live hinge line permitting the flange to be bent backwardly or forwardly. A second groove on the front surface of the flange on each of the short sides permits bending of the flange along the short sides. A third groove on the front surface of the flange along the short sides permits bending of the short sides about a second live hinge. Cutting lines are provided at right angles on the flange having live hinge to permit corners of the flange to be cut for use in replacement of a foundation vent.

DESCRIPTION OF THE DRAWINGS

FIG. 13 is a sectional view taken along the line 13—13 in FIG. 12.

FIG. 14 is a front elevational view of the plastic foundation vent as provided in an opening in a wall that has siding surrounding the opening.

FIG. 15 is a sectional view taken along the line 15—15 in FIG. 14.

FIG. 16 is a fragmentary sectional view taken along the lines 16—16 in FIG. 14.

DESCRIPTION OF THE PREFERRED EMBODIMENT

Figure 1:
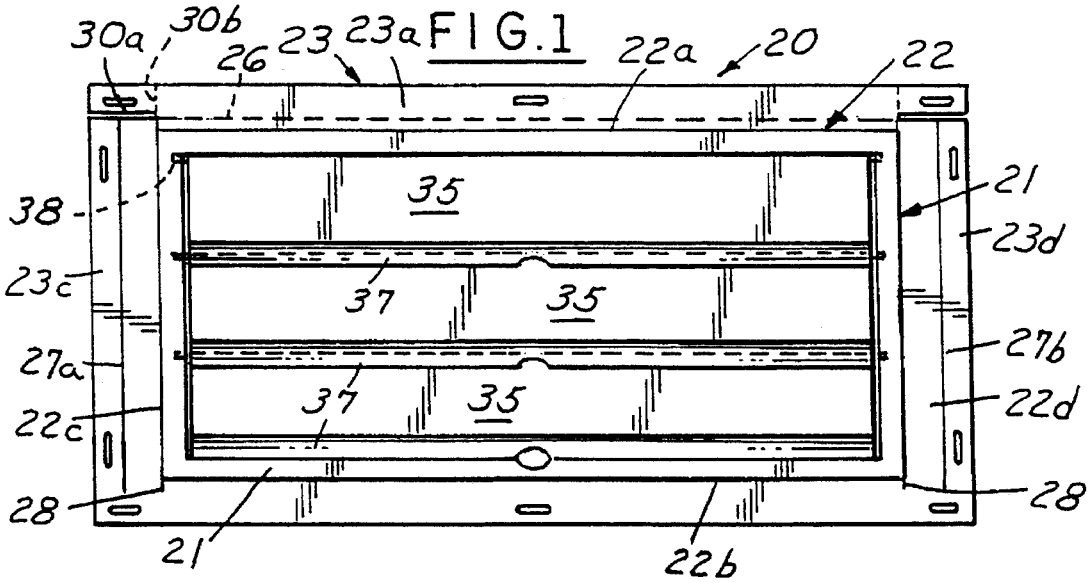
FIG. 1 is a front elevational view of a plastic foundation vent embodying the invention.
Figure 2:
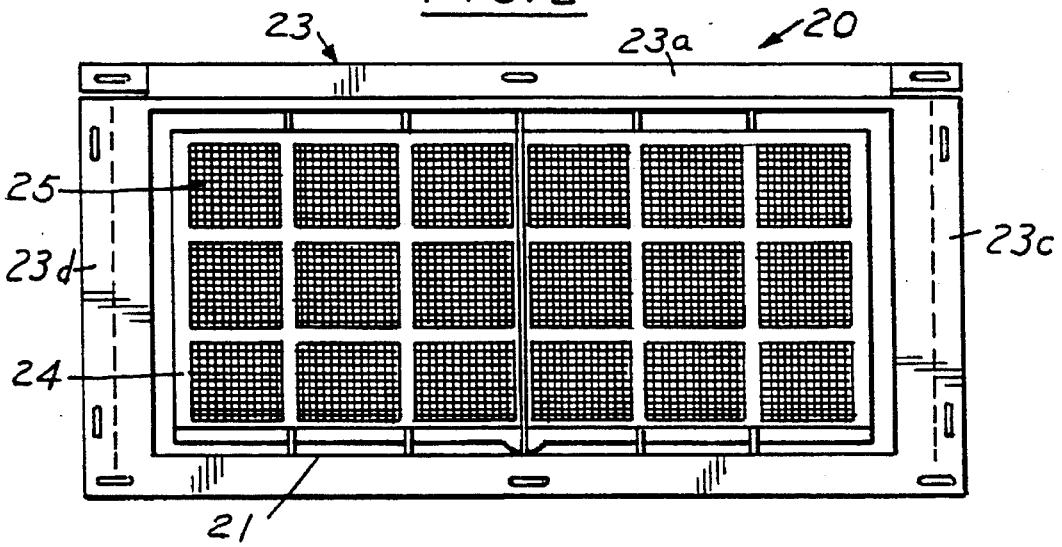
FIG. 2 is a rear elevational view of a plastic foundation vent.

Referring to FIGS. 1 and 2, the plastic foundation vent 20 embodying the invention comprises a plastic body 21 with an integral peripheral rectangular wall 22 surrounding the plastic body and defining opposed long sides **22*a*, 22*b* and opposed short sides 22*c*, 22*d*. An integral peripheral flange 23 extends outwardly from the peripheral wall. A central integral screen portion 24 having spaced portions 25 with openings for venting and prevention of entry of animals and the like is provided within the peripheral wall 22**. The plastic foundation vent is preferably made by injection molding. A preferred plastic is polypropylene.

The peripheral flange 23 has a front surface and a rear surface. A first groove 26 is provided on the rear surface of one portion **23*a* of the flange 23 on a long side 22*a* to define a live hinge line permitting portion 23*a* to bend backwardly or forwardly. Second grooves 27*a*, 27*b* on the front surface of the flange portion 23*c*, 23*d* on each of the short sides permits bending of the flange portions 23*c*, 23*d* along the short sides. A third groove 28 on the front surface of the flange along the short sides permits bending of the short sides about a second live hinge. Cutting lines 30*a*, 30*b* are provided at right angles on the flange portion 23*a* having live hinge to permit corners of the flange portion 23*a*** to be cut for use in replacement of a foundation vent.

Figure 4:
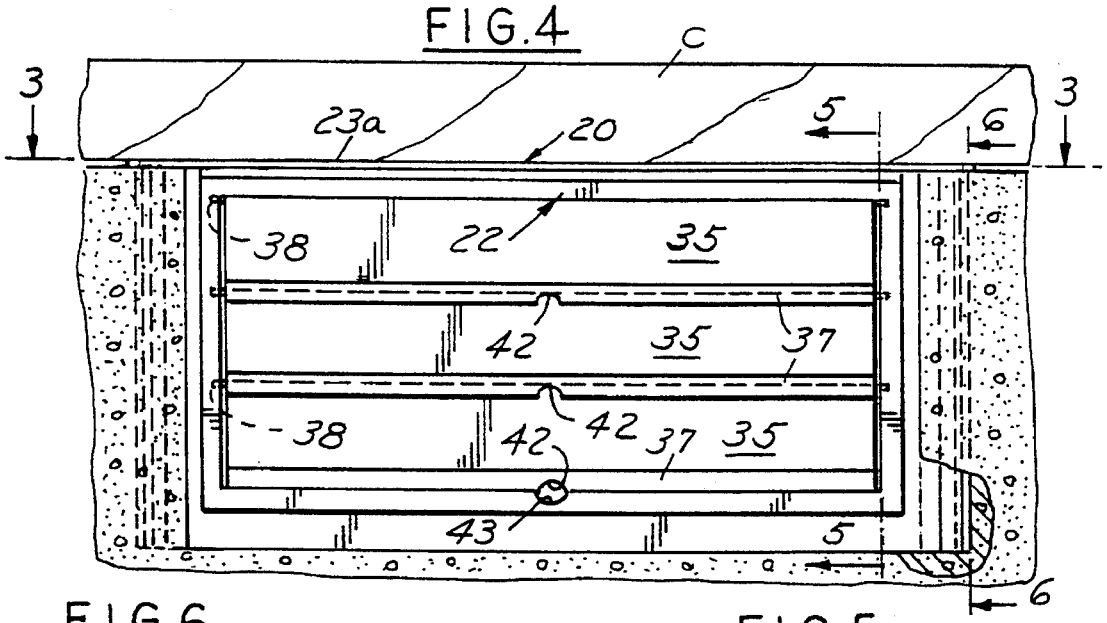
FIG. 4 is a front elevational view of the wall shown in FIG. 3.
Figure 6:
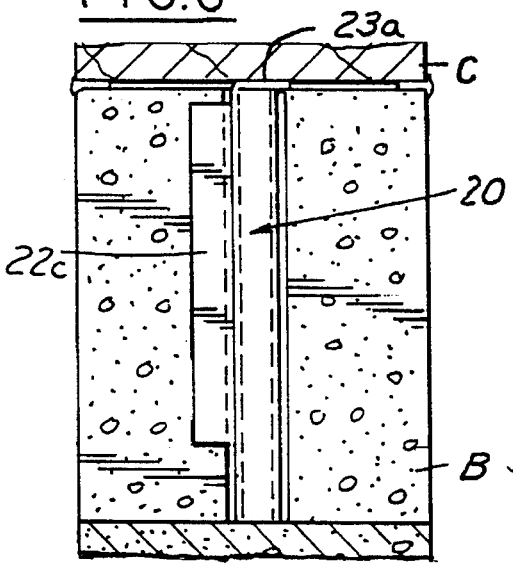
FIG. 6 is a sectional view taken along the lines 6—6 in FIG. 4.
Figure 5:
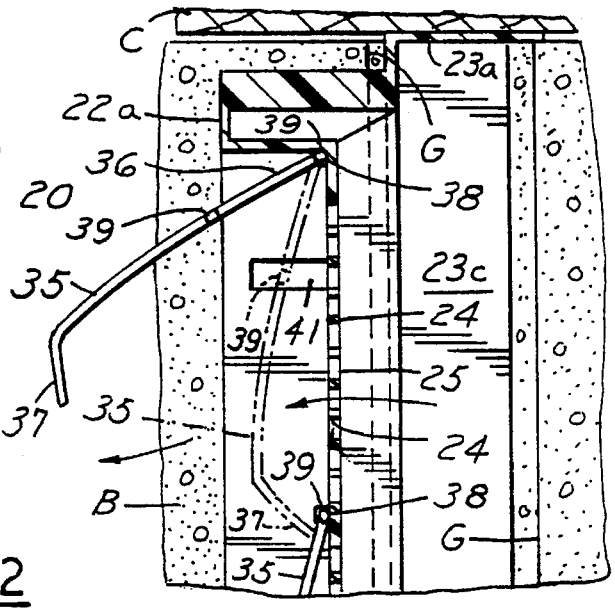
FIG. 5 is a fragmentary sectional view taken along the lines 5—5 in FIG. 4, on an enlarged scale.
Figure 7:
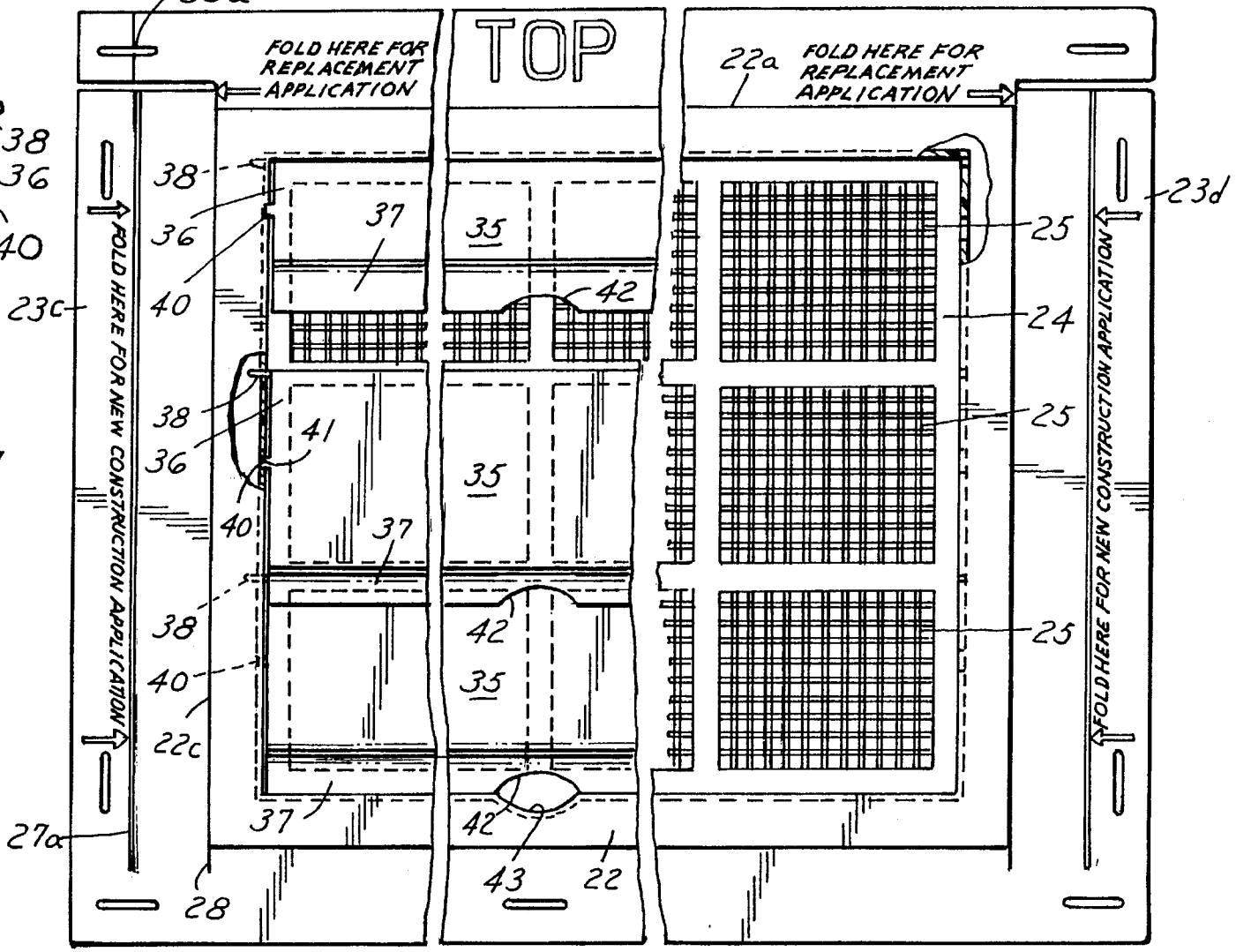
FIG. 7 is a fragmentary front elevational view on an enlarged scale.
Figure 8:
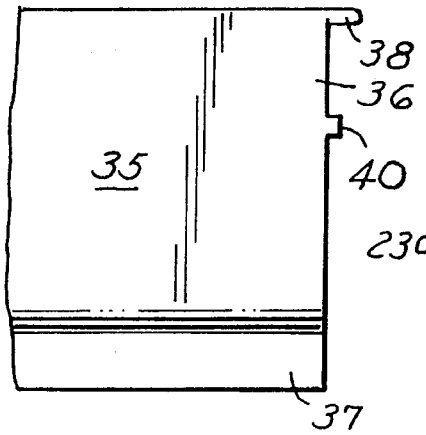
FIG. 8 is a fragmentary plan view of a louver utilized in the foundation vent.
Figure 9:
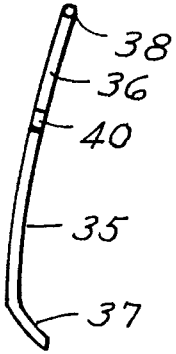
FIG. 9 is an end view of the louver.
Figure 10:
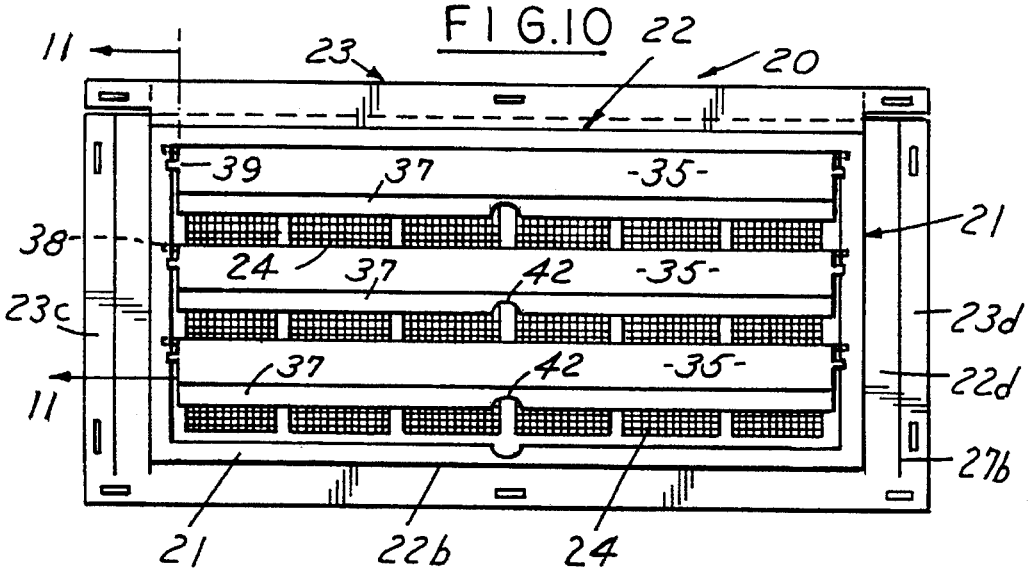
FIG. 10 is a front elevational view of the plastic foundation vent showing the louver in open position.
Figure 11:
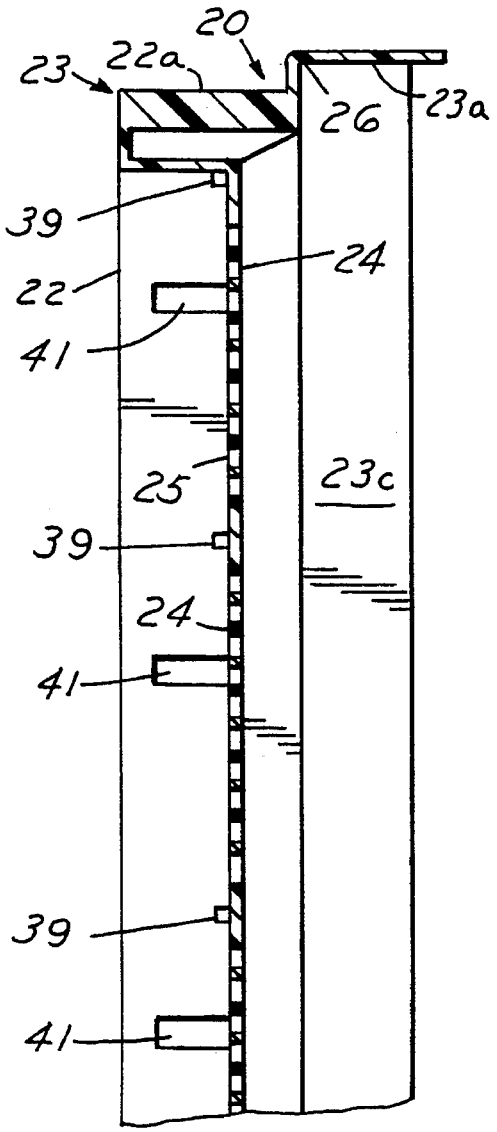
FIG. 11 is a sectional view taken along the lines 11—11 in FIG. 10 with the louvers removed.

Referring to FIGS. 1, 4, 5, 7–9, 10, and 12, the plastic foundation vent 20 is provided with a plurality of vertically spaced and horizontally extending movable louvers 35. Each louver includes an upper pivot end 36 and a lower bent end 37. Each louver further includes a laterally extending projection 38 that engages an opening 39 (FIG. 11) which is non-circular, herein shown as square into which the rectangular projection 39 extends. When the louver 35 is in the broken line position, as shown in FIG. 5, it is retained in that position such that the free end 37 overlaps the pivot of the louver 35 below. In this position, the louver has limited movement, as limited by lateral tabs 40 moving in an elongated horizontal recess 41. Each louver 35 can be grasped and snapped outwardly and upwardly to an open position and is held in an open position by lateral tabs 40 which engage the peripheral wall 22. In order to facilitate moving each louver 35 outwardly, each louver has a centrally located upwardly extending recess 42 into which the finger of a user can be inserted to raise the louver 35 to the open position. The peripheral wall 22 includes a recess 43 adjacent the lowest louver to further facilitate operation of the louvers (FIG. 7).

Figure 3:
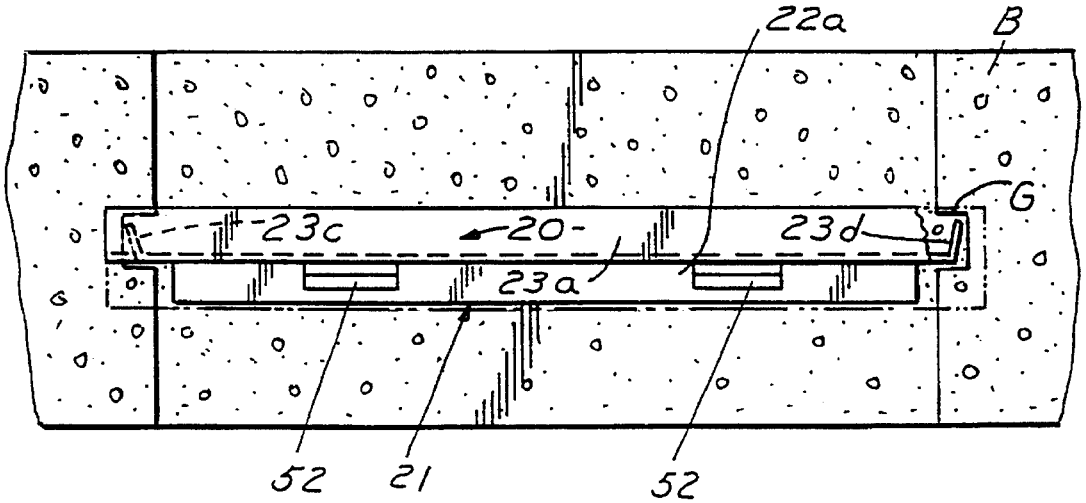
FIG. 3 is a top view showing the plastic foundation vent of FIGS. 1 and 2 in a cement block wall taken along the line 3—3 in FIG. 4.

Referring to FIGS. 3–6, the plastic foundation vent 20 embodying the invention can be utilized in new construction by bending flange portions **23*c*, 23*d* rearwardly along second hinge lines 27*a*, 27*b* and inserting the plastic foundation vent 20 downwardly into grooves G of cement blocks B that form the foundation (FIG. 3). A wood cross member C can then be applied in over relying relationship to the plastic vent after the flange portion 23***a* is bent rearwardly along the hinge line formed by groove 26 (FIG. 4).

Figure 12:
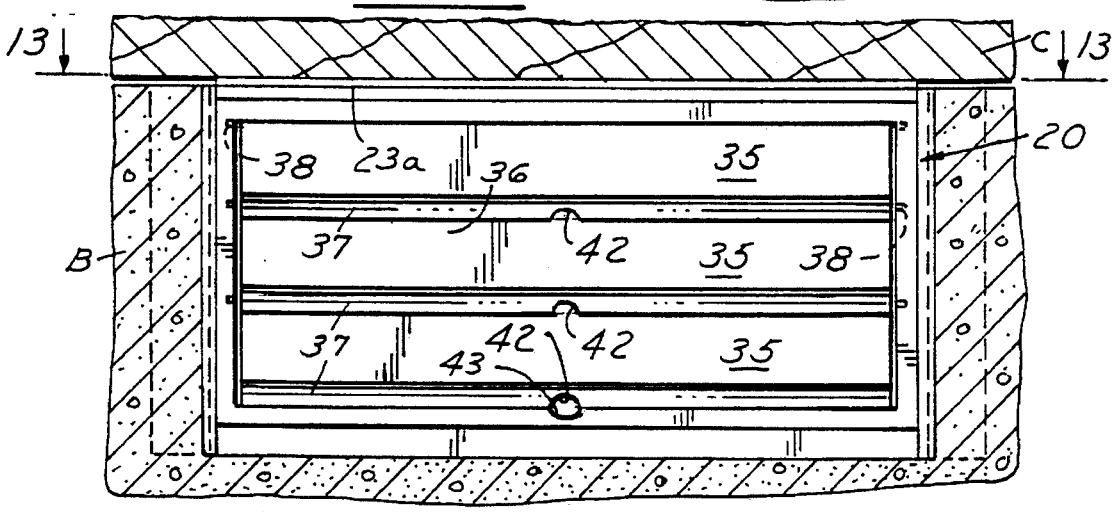
FIG. 12 is a front elevational view of the plastic foundation vent as utilized as a replacement in an existing foundation.

Referring to FIGS. 12 and 13, the plastic foundation vent 20 can be utilized as a replacement foundation vent where the existing foundation vent has been damaged by removing the existing foundation vent from the opening defined in the building. The corners of the top flanges are cut off and the side flanges are folded along the hinge lines 26, 28 so that the side peripheral flange 23*c*, 23*d* and top flange 22*a* extend rearwardly. The foundation vent 20 is then inserted into the opening. If accessible from the interior, cement nail N can be provided to hold the vent in position.

The plastic foundation vent 20 embodying the invention can also be used as a replacement vent in buildings having plastic siding S as shown in FIGS. 14–16 where the peripheral flange 23 is nailed to the foundation and the siding S is brought into overlapping relation to the flange 23. In this form the plastic foundation vent includes a peripheral ring 50 that has axially spaced teeth 51 engaging the teeth 52 on the peripheral wall 22 substantially as shown in U.S. Pat. No. 4,875,318, incorporated herein by reference.

In order to facilitate use of the plastic foundation vent 20 in a preferred formed, indicia are provided to facilitate the user. As shown in FIG. 7, each of the flanges has instructions for usage that includes the indicia for the user. Thus along the side flange portions which are to be folded or bent along the hinge line for a new construction arrows and indicia stating "FOLD HERE FOR A NEW CONSTRUCTION APPLICATION" are provided. For replacement use, indicia are provided on the top flange calling for with an arrow and indicia "FOLD HERE FOR REPLACEMENT APPLICATION". Further indicia on the top flange define the top or upper part of the plastic foundation vent.

It can thus be seen that there has been provided a plastic foundation vent which comprises a plastic body with an integral peripheral rectangular wall surrounding the plastic body and defining opposed long sides and opposed short sides. An integral peripheral flange extends outwardly from the peripheral wall. A central integral screen portion having openings for bending and prevention of entry of animals and the like is provided within the peripheral wall. The peripheral flange has a front surface and a rear surface. A first groove is provided on the rear surface of one of the flanges alongside to define a live hinge line permitting the flange to be bent backwardly or forwardly. A second groove on the front surface of the flange on each of the short sides permits bending of the flange along the short sides. A third groove on the front surface of the flange along the short sides permits bending of the short sides about a second live hinge. Cutting lines are provided at right angles on the flange having live hinge to permit corners of the flange to be cut for use in replacement of a foundation vent.

We claim:

1. A plastic foundation vent comprising a plastic body with an integral peripheral rectangular wall surrounding the plastic body and defining opposed long sides and opposed short sides, an integral peripheral flange extending outwardly from the peripheral wall, a central integral screen portion having openings, said peripheral flange having a front surface and a rear surface, a first groove provided on the rear surface of the top flange to define a live hinge line permitting the flange to be bent backwardly and forwardly, a second groove on the front surface of the flange on each of the short sides to permit bending of the flange along the short sides.

2. The plastic foundation vent set forth in claim 1 including a third groove along the front surface of the flange on each of the short sides forming a second line hinge to permit bending of the short sides.

3. The plastic foundation vent set forth in claim 2 including cutting lines at right angles at the sides of said top flange to facilitate cutting off the end of the top flange.

4. The plastic foundation vent set forth in anyone of claims 1–3 including instructional indicia on said vent indicating the lines along which the bending should occur.

5. The plastic foundation vent set forth in claim 4 including a plurality of horizontally extending vertically spaced louvers pivoted to said peripheral wall.

6. The plastic foundation vent set forth in claim 5 including interengaging means between said louvers and said peripheral wall limiting the normal movement between said louvers and said peripheral wall.

7. The plastic foundation vent set forth in claim 6 wherein said interengaging means comprise a generally horizontal recess in said wall and laterally extending tabs on each the ends of said louvers.

8. The plastic foundation vent set forth in claim 7 wherein said louvers are flexible such that they can be pivoted to bring the tabs out of said recesses and into engagement with said peripheral wall to hold the louvers in open position.

9. The plastic foundation vent set forth in claim 8 wherein each said louver includes a lower edge, each louver edge having a finger receiving recess to facilitate opening each louver.

10. The plastic foundation vent set forth in claim 9 wherein said peripheral wall has a finger receiving recess adjacent the lower edge of said lowermost louver.

* * * * *